US008689978B2

(12) United States Patent
Flood et al.

(10) Patent No.: US 8,689,978 B2
(45) **Date of Patent: *Apr. 8, 2014**

(54) HINGED CONTAINER HOLDER FOR MEDICATION CARDS

(71) Applicant: Berlin Packaging, LLC, Chicago, IL (US)

(72) Inventors: Nora Flood, Chicago, IL (US); Liam Hawry, Chicago, IL (US); Brett Niggel, St. Cory, PA (US); Scott Jost, Glen Ellyn, IL (US)

(73) Assignee: Berlin Packaging, LLC, Chicago, IL (US)

( * ) Notice: Subject to any disclaimer, the term of this patent is extended or adjusted under 35 U.S.C. 154(b) by 2 days.

This patent is subject to a terminal disclaimer.

(21) Appl. No.: 13/666,037

(22) Filed: Nov. 1, 2012

(65) Prior Publication Data

US 2013/0112588 A1 May 9, 2013

Related U.S. Application Data

(60) Provisional application No. 61/555,059, filed on Nov. 3, 2011.

(51) Int. Cl.
*B65D 83/04* (2006.01)
*A61J 1/03* (2006.01)

(52) U.S. Cl.
CPC .. *A61J 1/03* (2013.01); *B65D 83/04* (2013.01)
USPC ..... 206/535; 206/531

(58) Field of Classification Search
CPC ..... B65D 33/01; B65D 75/30; B65D 83/04; A61J 1/03
USPC ..... 206/1.5, 425, 499, 535, 536, 538, 539, 206/531
See application file for complete search history.

(56) References Cited

U.S. PATENT DOCUMENTS

| | | | | |
|---|---|---|---|---|
| 2,366,886 | A | | 1/1945 | Van Tuyl |
| 3,504,788 | A | | 4/1970 | Gray |
| 3,552,595 | A | | 1/1971 | Gerner |
| 3,579,883 | A | | 5/1971 | Hayes |
| 3,630,171 | A | | 12/1971 | Huck |
| 3,737,029 | A | | 6/1973 | Serrell et al. |
| 4,124,190 | A | | 11/1978 | Reedy et al. |
| 4,340,141 | A | | 7/1982 | Fischer |
| 4,955,481 | A | | 9/1990 | Novinski et al. |
| 4,974,729 | A | | 12/1990 | Steinnagel |
| 5,033,634 | A | * | 7/1991 | Batchelor et al. ..... 206/1.5 |
| 5,050,739 | A | | 9/1991 | Hannan et al. |
| 5,109,984 | A | | 5/1992 | Romick |
| 5,265,728 | A | | 11/1993 | Allendorf et al. |
| 5,323,907 | A | | 6/1994 | Kalvelage |
| 5,351,818 | A | | 10/1994 | Daneshvar |
| 5,549,202 | A | | 8/1996 | Whiteside |

(Continued)

*Primary Examiner* — Bryon Gehman
(74) *Attorney, Agent, or Firm* — Adam K. Sacharoff

(57) ABSTRACT

There is shown in three embodiments a pill blister pack container for holding a pill blister pack. The container having a first portion highedly attached to a second portion. The first portion being sized to fit within the second portion when the container is closed. Both the first and second portions have defined side walls and a front wall. In addition, the first portion includes flanges in the side walls that engage apertures in the second portion to lock the two portions. Furthermore, at least one support post extends between the two portions.

12 Claims, 3 Drawing Sheets

(56) References Cited

U.S. PATENT DOCUMENTS

| | | | | |
|---|---|---|---|---|
| 5,549,204 | A | 8/1996 | Toren | |
| 5,740,938 | A * | 4/1998 | Hofmann et al. | 206/531 |
| 6,173,838 | B1 * | 1/2001 | Brozell | 206/538 |
| 6,244,462 | B1 | 6/2001 | Ehrensvard et al. | |
| 6,253,920 | B1 | 7/2001 | Kallgren | |
| 6,293,403 | B1 | 9/2001 | Holmberg | |
| 6,338,408 | B1 | 1/2002 | Anderson | |
| 6,394,275 | B1 | 5/2002 | Paliotta et al. | |
| 6,679,381 | B1 | 1/2004 | Bush | |
| 6,708,826 | B1 * | 3/2004 | Ginsberg et al. | 206/535 |
| 6,832,686 | B2 * | 12/2004 | Donegan | 206/1.5 |
| 6,913,149 | B2 | 7/2005 | Gelardi et al. | |
| 7,025,207 | B2 | 4/2006 | Breu et al. | |
| 7,093,736 | B2 | 8/2006 | Maietta et al. | |
| 7,150,355 | B2 | 12/2006 | Coe et al. | |
| 7,188,729 | B2 * | 3/2007 | DeJonge | 206/535 |
| 7,357,255 | B2 * | 4/2008 | Ginsberg et al. | 206/535 |
| 7,419,056 | B2 | 9/2008 | Gattefosse et al. | |
| 7,434,692 | B2 * | 10/2008 | Ginsberg et al. | 206/535 |
| RE40,612 | E | 12/2008 | Paliotta et al. | |
| 7,464,818 | B2 | 12/2008 | Gherdan et al. | |
| 7,464,819 | B2 | 12/2008 | Maietta | |
| 7,549,541 | B2 * | 6/2009 | Brozell et al. | 206/538 |
| 7,607,538 | B2 | 10/2009 | Silvenis et al. | |
| 7,617,935 | B2 * | 11/2009 | Reilley et al. | 206/1.5 |
| 8,220,636 | B2 * | 7/2012 | Beecroft et al. | 206/535 |
| 2002/0166792 | A1 | 11/2002 | Filion et al. | |
| 2004/0026293 | A1 | 2/2004 | Hughes | |
| 2004/0050748 | A1 | 3/2004 | Ehrlund | |
| 2004/0108240 | A1 | 6/2004 | Ragot | |
| 2005/0173291 | A1 | 8/2005 | Specker et al. | |
| 2006/0051457 | A1 | 3/2006 | Bougoulas et al. | |
| 2007/0138049 | A1 | 6/2007 | Bitner | |
| 2007/0227931 | A1 | 10/2007 | Shane | |
| 2008/0017542 | A1 | 1/2008 | Le et al. | |
| 2008/0202972 | A1 | 8/2008 | Prud'Homme | |
| 2008/0265011 | A1 | 10/2008 | Specker | |
| 2009/0084801 | A1 | 4/2009 | Cow | |
| 2009/0166244 | A1 | 7/2009 | Seymour | |
| 2009/0184023 | A1 | 7/2009 | Brollier et al. | |
| 2009/0255842 | A1 * | 10/2009 | Brozell et al. | 206/538 |
| 2009/0283437 | A1 * | 11/2009 | Angelucci et al. | 206/532 |
| 2010/0012544 | A1 | 1/2010 | Paliotta et al. | |
| 2011/0259783 | A1 * | 10/2011 | Angelucci et al. | 206/538 |

* cited by examiner 100
105
110
111
115
117
120
125
130
135
140
145
165
171
175
177
180
181
182
184
188
190
192
194
196
198
208
210
210'
210"
212
212'
212"
214
216
220
222
222'
229

HINGED CONTAINER HOLDER FOR MEDICATION CARDS

CROSS REFERENCE TO RELATED APPLICATIONS

The present invention is a nonprovisional application of U.S. application Ser. No. 61/555,059 filed Nov. 3, 2011, the contents of which are incorporated herein by reference.

FIELD OF THE INVENTION present invention relates to various medicine or pill containers.

BACKGROUND OF THE INVENTION

There are various pill dispensers available in the marketplace and the need to provide improvements and different types exist as well. There is thus disclosed herein one or more embodiments directed to holding pills and/or pill blister packs.

SUMMARY OF THE INVENTION

In one embodiment of the present invention there is provided a flip pill blister holder container. The number of blister packs each container holds may be different and may depend on the internal volume of each container. In summary, the container is defined by a two piece housing divided simply as a first portion highedly attached about a first edge to a second portion. The first portion includes a base and a first front wall distal to the first edge and extending away from the base. The first portion further includes a pair of first side walls also extending away from the base but further being separately positioned between the first edge and the first front wall. Each first side wall having a flange extending from the base. The second portion includes a top and a second front wall distal to the first edge and extending away from the top. The second portion further includes a pair of second side walls extending away from the top and separately positioned between the first edge and the second front wall. Each second side wall further has an aperture configured to receive and secure one of the flanges when the container is in a closed position. And wherein the first portion has an outer parameter smaller than an inner parameter defined by the second portion, such that when the container is in the closed position, a portion of the first portion fits between a portion of the second portion. Moreover, at least one support post extends between the top and the base, such that each of the at least on support post is sized to receive the at least one opening defined by the pill blister pack.

In other aspects of the embodiment, a channel is configured to extend from outside edges on the first edge and around a portion of the top containing a support post to define within the channel a support member portion. Each of the support posts is a two piece interlocking support member having a first piece extending from the base towards a second piece that extends from the top towards the first piece. Therefore, when the container is in the closed configuration, the interlocking means secures the two pieces together such that when the container is re-opened the interlocking support member maintains a secure engagement between the first and second piece interlocking support posts at the same time the top is capable of moving to an opened position.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
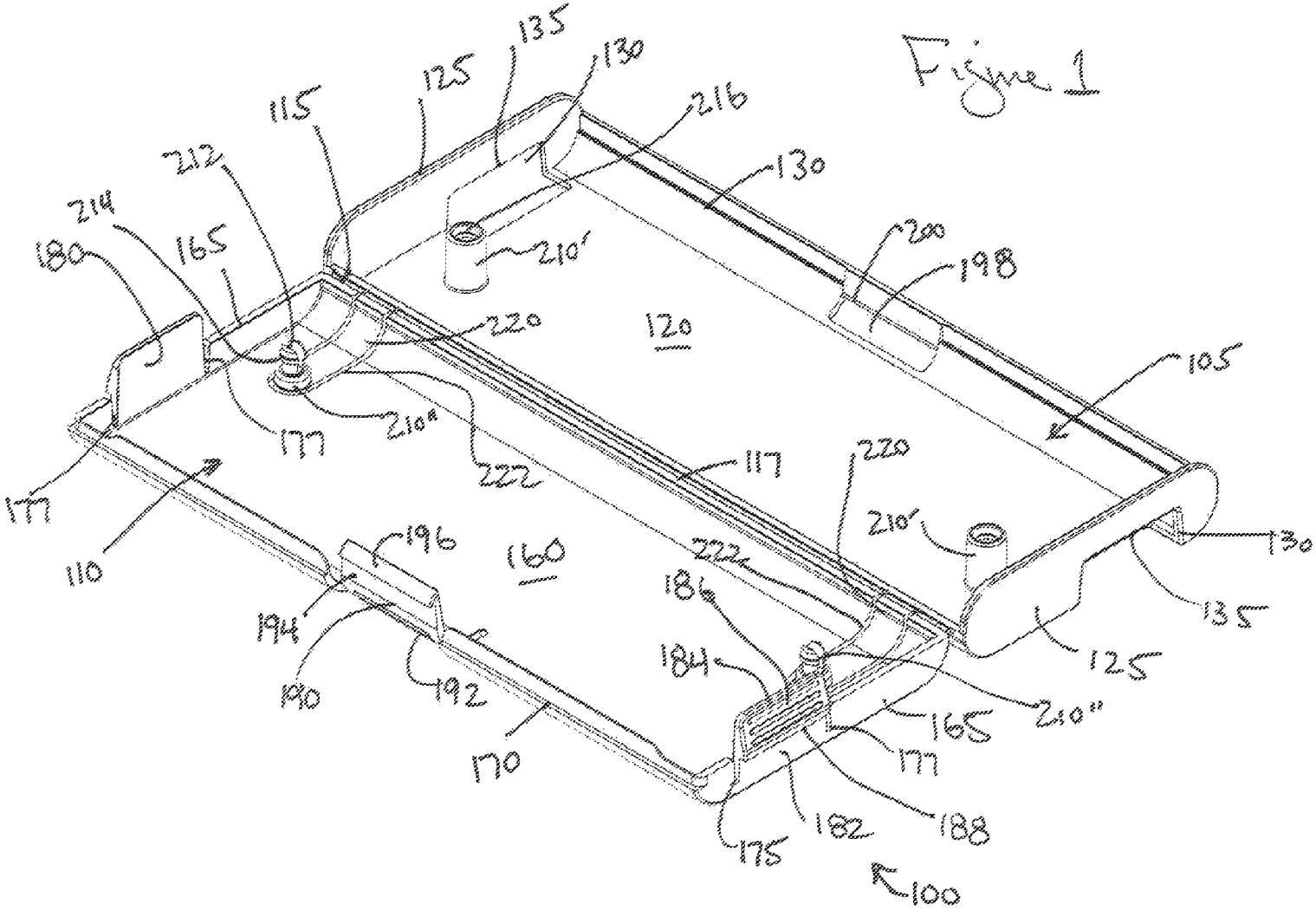
FIG. 1 is a perspective view of a first embodiment in accordance with the present invention illustrating the container is an opened configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

Referring now to FIGS. 1-4, there is shown in a first embodiment a book type container for holding pill blister cards 100. The container 100 includes a bottom portion 105 and a top portion 110 hinged about adjacent edges 115. The hinge can be a living hinge 117 formed into the container or a separate means for hinging the two together.

The bottom portion 105 includes a base 120 with a pair of bottom side walls 125 and a bottom front wall 130. The bottom front wall 130 extends away from the base 120 and is distal to the adjacent edges 115. The pair of bottom side walls 125 extend away from the base 120 and are positioned between the adjacent edges 115 and the bottom front wall 130.

Each bottom side wall 125 includes an aperture 130 positioned and sized to receive a flange, defined herein below. The aperture 130 includes an intermediate aperture edge 135 configured to engage the flange, discussed below.

The top portion 110 includes a top 160 with a pair of top side walls 165 and a top front wall 170. The top front wall 170 extends away from the top 160 and is distal to the adjacent edges 115. The pair of top side walls 165 extend away from the top 160 and are positioned between the adjacent edges 115 and the top front wall 170. A notch 175 is positioned in each bottom side wall 125. In one embodiment the notch 175 is positioned towards the top front wall 170. The notch 175 defines notch edges 177 in the top side wall 165. Positioned in each notch 175 is a resilient flange 180. The flange 180 includes a lower portion 182 connected to a portion of the top side wall 125 and an upper portion 184. The upper portion 184 may be slightly thicker then the lower portion 182 defining an intermediate flange edge 188. The flange 180 may also include a tab region 186. The flange 180 is resilient at least about the lower portion 182 to permit the flange to be pressed inwardly as discussed further below and to allow it to form back to an original position. When closed, the intermediate flange edge 188 engages the intermediate aperture edge 135 to help keep the container in a closed configuration.

Figure 2:
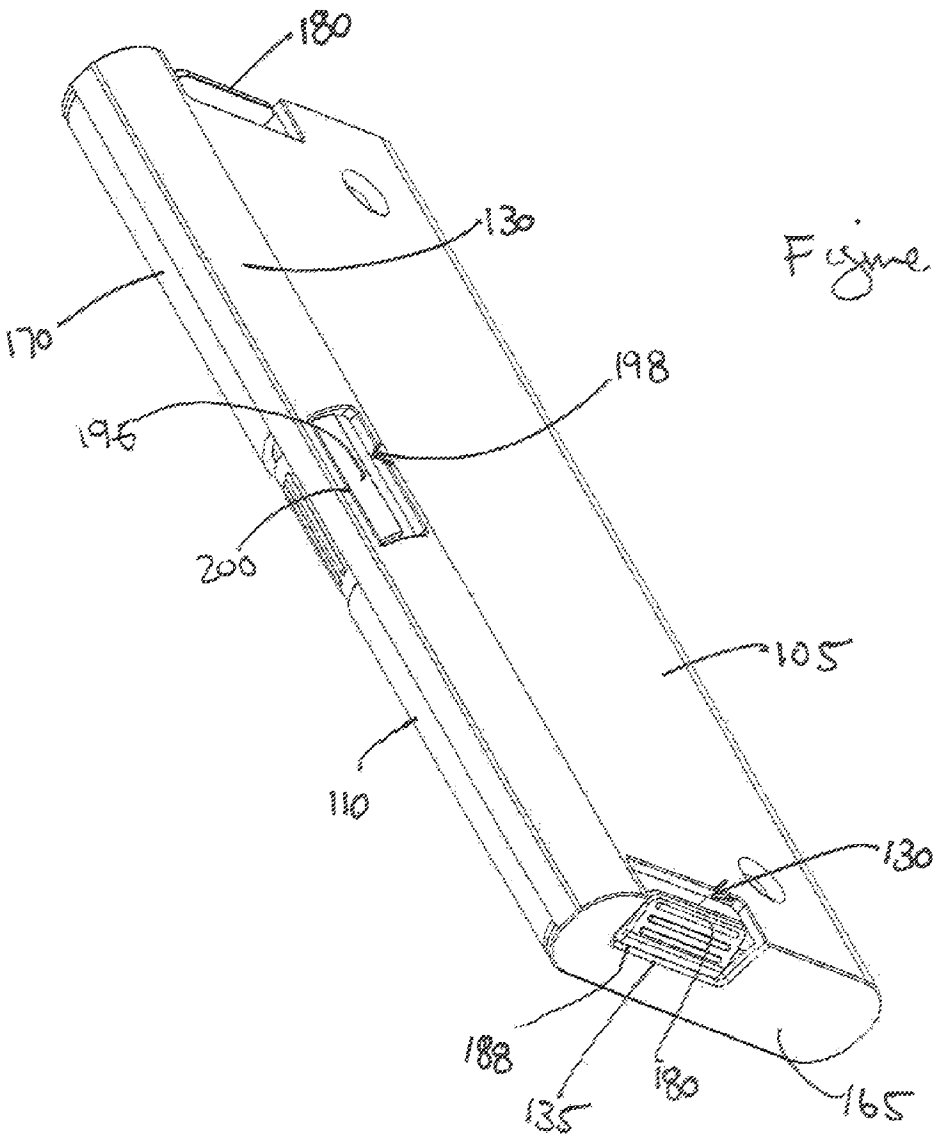
FIG. 2 is a perspective view of a container in a closed configuration.

In addition, the top portion 110 has an outer diameter smaller then the bottom portion 105, such that when the container 100 is in a closed position, shown in FIG. 2, the top side walls fit within the bottom side walls. As illustrated in the dosed position, the flanges 180 position in the apertures 130 such that the intermediate flange edge 188 engages the intermediate aperture edge 135, locking or securing the container 100 in the closed position. To open, the flanges are pressed inwardly until the intermediate flange edge 188 disengages the intermediate aperture edge 135.

The top front wall 170 may also include a centered front flange 190 that includes a lower section 192 connected to the top 160 or top front wall 170. The flange 190 further includes an upper section 194 with a extended lip 196. Corresponding to the front flange on the top front wall is a centered bottom aperture 198 positioned in the bottom front wall 130 and includes an interior aperture edge 200 configured to engage the extended lip 196 when the container 100 is in the closed configuration. When opening, the side flanges and the front flanges must be worked in concert (i.e. pressed inwardly) to open the container 100. This added securing method helps to prevent children from opening the container.

Figure 3:
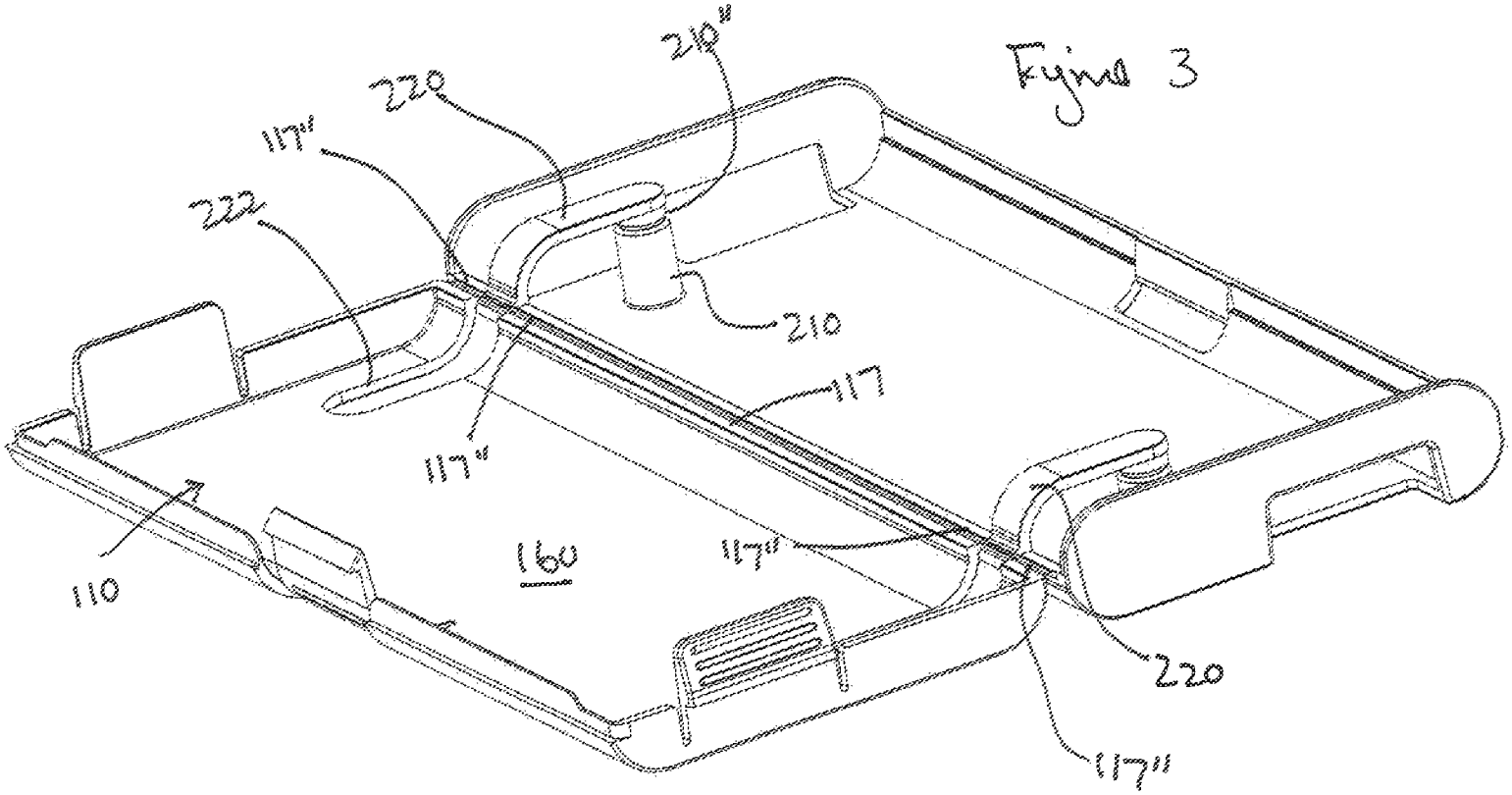
FIG. 3 is a perspective view of a container in the opened configuration.

Continuing to refer to FIG. 1 and also now to FIG. 3, the container 100 may include at least one support member 210 extending between the top and bottom portions. The at least one support member 210 is configured to hold a blister pack or blister card. Typically the blister pack or card will having uniform openings allowing the blister pack or card to be slipped onto the support member 210. The support members 210 can be a single member or they can be a two piece support 210' and 210", each piece of the support can extend away from either the top or bottom towards the other portion. In this example, each piece of the support is configured to meet the corresponding support piece. The two piece support may be a male/female interlocking support member with the male member having a split edge 212 with outwardly extending ribs 214 configured to engage inwardly extending ribs 216 in the female interlocking support member. The split edge 212 creates multiple outwardly extending segments that can be squeezed and positioned into the female interlocking support member.

Once the blister packs are loaded onto the support members 210 and the container is closed, the multi-piece support members 210 interlock and can be maintained in a secure closed position, even when the container is moved back to the open position, FIG. 3.

As further provided in FIG. 3, the top portion 110 includes a support member section 220 defined in the top 160 around the support member 210". The support member section 220 includes a channel 222 extending from the adjacent edges 117 and moving to surround and separate the support member section 220. When the support members 210" are interlocked, the support member section 220 will be held connected to the support member 210" while the rest of the top portion 110 will open about the channel 222 via outside adjacent edges 117" positioned on the outside of the channel 222. During this process the support member portion 190 stays hinged to the bottom portion. As illustrated, the support member section 220 may encompass a single support member 100 providing for multiple support member sections 220" when the container includes more than one support member 210. As illustrated, when reopened the support member sections 220 being connected to the support members 210 create gaps or openings in the top 160.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A pill blister pack container for holding a pill blister pack, the pill blister pack having at least one opening, the container comprising:

a bottom portion highedly attached to a top portion about a first edge;

the bottom portion includes a base and a bottom front wall distal to the first edge and extending away from the base, the bottom portion further includes a pair of bottom side walls extending away from the base and separately positioned between the first edge and the bottom front wall, and wherein each bottom side wall has an aperture defined therein;

the top portion includes a top and a top front wall distal to the first edge and extending away from the top, the top portion further includes a pair of top side walls extending away from the top and separately positioned between the first edge and the top front wall, and wherein each top side wall includes a flange extending from the base and being positioned within a portion of a respective side wall to correspond to one of the apertures in the bottom side walls such that when the container is in a closed position the flanges are positioned within the apertures;

wherein the top portion has an outer parameter smaller than an inner parameter defined by the bottom portion, such that when the container is in the closed position, the top side walls fit between the bottom side walls; and a pair of support posts extending between the top and base, each of the support posts being sized to separately receive an opening defined by the pill blister pack.

2. The container of claim 1, wherein the top front wall further includes a centered clasp configured to correspond to a centered opening in the bottom front wall when the container is in the closed position.

3. The container of claim 2, wherein the clasp includes an extending lip configured to engage a portion of the centered opening when the container is in the closed configuration.

4. The container of claim 1, wherein each of the support posts separately includes a channel extending from outside edges on the first edge and around a portion of the top containing at least one of the support posts to define within the channel a support member portion; and wherein each of the support posts is a two piece interlocking support member, the interlocking support member having a first piece extending from the base towards a second piece that extends from the top towards the first piece, the two piece interlocking support member having a means to interlock the two pieces together, and wherein when the container is in the closed configuration, the means to interlock the two pieces together secures the two pieces together such that when the container is re-opened the interlocking support member maintains a secure engagement between the first piece and the second piece of the two piece interlocking support member at the same time the top is capable of moving to an opened position.

5. The container of claim 1, wherein each flange is positioned within a notch defined in the top side wall.

6. The container of claim 5, wherein each flange includes a lower portion connected to a portion of the top side wall and includes an upper portion, the upper portion being thicker than the lower portion to define an intermediate flange edge between the upper portion and the lower portion.

7. The container of claim 6, wherein each aperture being further configured to include an intermediate aperture edge for engagement with the intermediate flange edge when the container is in a closed configuration.

8. The container of claim 7, wherein each flange is made from a resilient material configured to permit the upper portion to be forced inwardly such that when the force is removed the flange has a tendency to return to an original configuration.

9. A pill blister pack container for holding a pill blister pack, the pill blister pack having at least one opening, the container comprising:

a housing defined into a first portion highedly attached about a first edge to a second portion;

the first portion includes a base and a first front wall distal to the first edge and extending away from the base, the first portion further includes a pair of first side walls extending away from the base and separately positioned between the first edge and the first front wall, and each first side wall having an aperture configured therein;

the second portion includes a top and a second front wall distal to the first edge and extending away from the top, the second portion further includes a pair of second side walls extending away from the top and separately positioned between the first edge and the second front wall, each first side wall having a flange extending from the base and configured to engage the aperture in each first side wall when the container is in a closed configuration;

wherein the second portion has an outer parameter smaller than an inner parameter defined by the first portion, such that when the container is in the dosed position, the second side walls fit between portions of the first side walls; and at least one support post extending between the top and the base, each of the support posts being sized to receive the at least one opening defined by the pill blister pack.

10. The container of claim 9, wherein the first front wall further includes a clasp having an extending lip configured to engage a centered opening on the second front wall when the container is in the closed configuration.

11. The container of claim 9, wherein the top includes a channel extending from outside edges on the edge, around a portion of the top containing the at least one support posts, and to an inside section of the edge to define within the channel a support member portion; and wherein each of the support posts is a two piece interlocking support member, the interlocking support member having a first piece extending from the base towards a second piece that extends from the top towards the first piece, the two piece interlocking support member having a means to interlock the two pieces together, and wherein when the container is in the dosed configuration, the interlocking means secures the two pieces together such that when the container is re-opened the interlocking support member maintains a secure engagement between the first piece and the second piece of the two piece interlocking support member at the same time the top is capable of moving to an opened position.

12. The container of claim 9, wherein each flange includes a lower portion connected to a portion of the bottom side wall and includes an upper portion, the upper portion being thicker than the lower portion to define an intermediate flange edge between the upper and lower portions.

* * * * *